US007922153B2

(12) United States Patent
Zhou et al.

(10) Patent No.: US 7,922,153 B2
(45) Date of Patent: Apr. 12, 2011

(54) VARIABLE SPEED WINCH

(75) Inventors: Norman Zhou, Woodbury, MN (US); Zhongcheng Peng, Jinhua (CN)

(73) Assignee: Runva Mechanical & Electrical Co, LLC, Woodbury, MN (US)

( * ) Notice: Subject to any disclaimer, the term of this patent is extended or adjusted under 35 U.S.C. 154(b) by 175 days.

(21) Appl. No.: 12/410,717

(22) Filed: Mar. 25, 2009

(65) Prior Publication Data

US 2010/0065799 A1 Mar. 18, 2010

Related U.S. Application Data

(60) Provisional application No. 61/192,110, filed on Sep. 16, 2008.

(51) Int. Cl.
*B66D 1/22* (2006.01)

(52) U.S. Cl. ..... 254/344; 254/323

(58) Field of Classification Search ..... 254/344, 254/342, 323, 362

See application file for complete search history.

(56) References Cited

U.S. PATENT DOCUMENTS

| | | | | |
|---|---|---|---|---|
| 3,797,325 | A | 3/1974 | Christison | |
| 4,453,701 | A * | 6/1984 | Huggett | 254/371 |
| 4,461,460 | A | 7/1984 | Telford | |
| 4,545,567 | A | 10/1985 | Telford et al. | |
| 4,563,757 | A * | 1/1986 | Decorps et al. | 367/33 |
| 4,575,831 | A * | 3/1986 | Decorps et al. | 367/33 |
| 4,736,929 | A | 4/1988 | McMorris | |
| 5,692,735 | A | 12/1997 | Aho et al. | |
| 5,842,684 | A | 12/1998 | Aho | |
| 6,604,731 | B2 | 8/2003 | Hodge | |
| 7,000,904 | B2 * | 2/2006 | Huang | 254/323 |

* cited by examiner

*Primary Examiner* — Emmanuel M Marcelo
(74) *Attorney, Agent, or Firm* — IPLM Group, P.A.

(57) ABSTRACT

A variable speed winch in one embodiment includes a drive shaft, a power source, a single gear operation lever, a variable gearing system and a drum. The power source is configured to rotate the drive shaft. The variable gearing system is in rotational connection with the drive shaft and is configured to change the gearing of the winch based on the rotation of the single gear operation lever. The drum is in rotational connection with the variable gearing system.

17 Claims, 7 Drawing Sheets

VARIABLE SPEED WINCH

CROSS REFERENCE TO RELATED APPLICATIONS

The present application claims priority to Provisional Patent Application No. 61/192,110, entitled "Two-Speed Synchronized and Integrated Clutch for Winches" filed on Sep. 16, 2008 which is incorporated in its entirety herein.

BACKGROUND

One method of moving heavy objects is with the use of a winch. Generally, there are two types of winches, an electrical winch and a hydraulic winch. An electrical winch uses electrical motor to move gearing in the winch to wind a cable around a drum assembly. A hydraulic winch uses hydraulic fluid to move the gearing in the winch to activate the drum assembly. In each type of winch, the gearing is configured to slowly move the drum assembly with a lot of power. However, the slow movement of the drum assembly can be more than an annoyance when no pull is needed and it is desired to roll up the cable.

For the reasons stated above and for other reasons stated below which will become apparent to those skilled in the art upon reading and understanding the present specification, there is a need in the art for a winch that effectively and efficiently has a more than one gearing speed.

SUMMARY OF INVENTION

The above-mentioned problems of current systems are addressed by embodiments of the present invention and will be understood by reading and studying the following specification. The following summary is made by way of example and not by way of limitation. It is merely provided to aid the reader in understanding some of the aspects of the invention.

In one embodiment, a variable speed winch is provided. The winch includes a drive shaft, a power source, a single gear operation lever, a variable gearing system and a drum. The power source is configured to rotate the drive shaft. The variable gearing system is in rotational connection with the drive shaft and is configured to change the gearing of the winch based on the rotation of the single operation lever. The drum is in rotational connection with the variable gearing system.

BRIEF DESCRIPTION OF THE DRAWINGS

The present invention can be more easily understood and further advantages and uses thereof more readily apparent, when considered in view of the detailed description and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide an effective and efficient shifting system that allows for more than one gearing speed in a winch. In embodiments of the winch, gearing of the winch between a low gear, free spool and high gear is achieved with the simple rotation of a single operation lever. Hence, embodiments of the winch can go from a low pulling gear to a high retrieving gear with the rotation of a single operation lever. In embodiments, the synchronized shifting of gears is achieved without manually adjusting the drum of the winch to match a gear as is required in other winch configurations. In one embodiment, the high gear speed is about 40 m/min with a current load of 100 A. Embodiments provide not only speed advantages over other winches but also a reduction in required energy to operate.

Figure 1A:
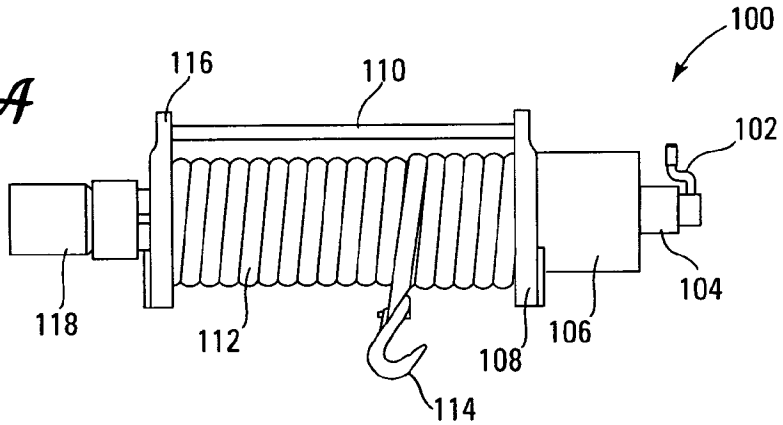
FIG. 1A is a front view of a winch of one embodiment of the present invention.

Referring to FIG. 1A, a front view of a winch 100 of one embodiment is illustrated. On a power side, the winch 100 includes a motor 118 and a front bearing 116. The motor 118 may be any type of motor used to provide power to the winch, such as but not limited to an electrical motor or a hydraulic motor. A gearing side of the winch includes a gear operation lever 102, a gear housing 104, a ring assembly 106 and an end bearing 108. The gear operation lever 102 (operation lever 102) in embodiments is simply rotated in relation to the gear housing 104 to select a gear. The gear housing 104 and ring assembly 106 house the gearing of the winch 100. The gearing of various embodiments are discussed below. Between the power side and the gearing side of the winch 100 includes at least one tie bar 110 and a cable 112 with a hook 114. The cable 112 is wound around a drum that rotates as described below.

Figure 1B:
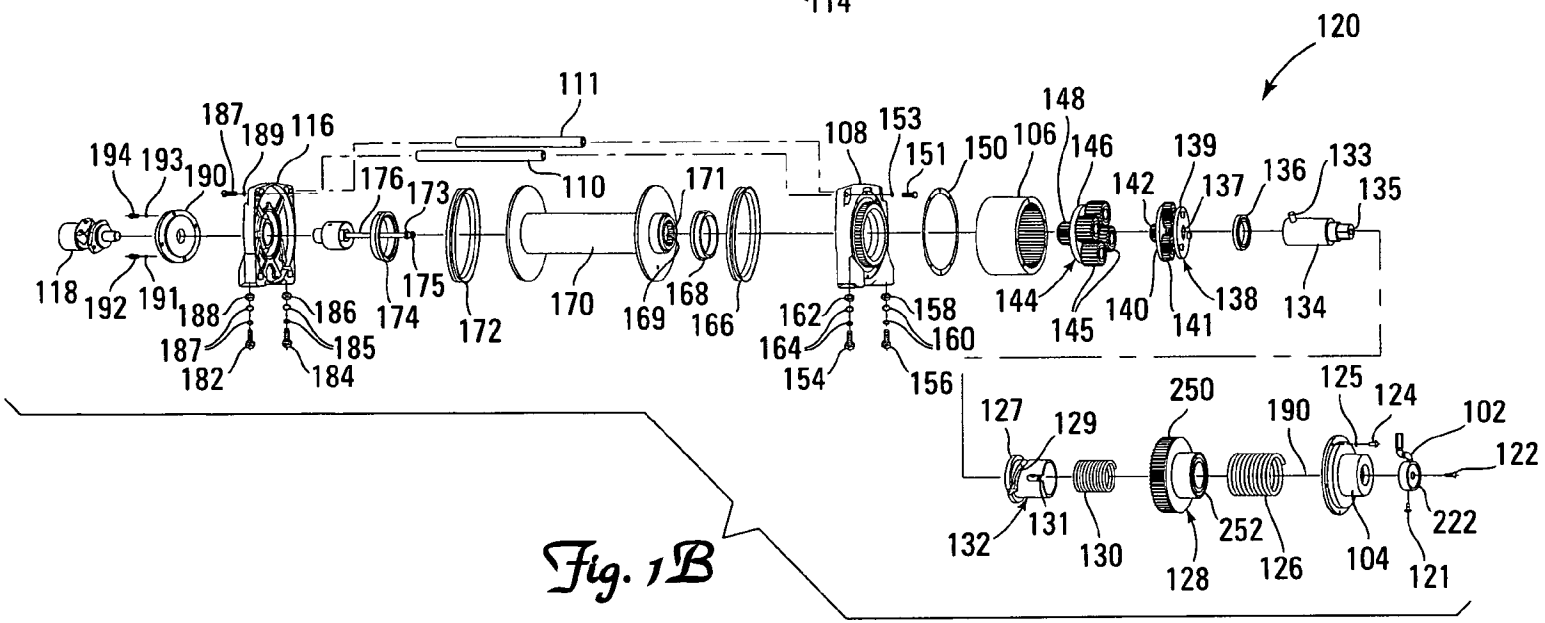
FIG. 1B is an exploded view of a winch illustrating parts of the winch of one embodiment of the present invention.

A further example of an embodiment of a winch 120 is illustrated in the exploded side perspective view of FIG. 1B. As illustrated, the winch 120 has a power end that includes a motor 118, a coupling plate 190 and a front bearing 116. In this embodiment, the coupling plate 190 is connected to the front bearing 116 via fasteners 192, 194, 191 and 193. In particular, the fasteners include screws 192 and 194 and washers 191 and 193. Also illustrated in the embodiment of FIG. 1B is drive shaft 176. The drive shaft 176 is coupled to the motor 118. Hence, the motor 118 is coupled to provide a rotational movement of drive shaft 176. The drive shaft 176 includes a drive shaft sun gear 173 and an end gear 175. The drive shaft 176 extends through a bore 169 in a drum assembly 170 and is rotationally coupled to a clutch axis assembly 134. In particular, the drive shaft 176 is coupled to the clutch axis assembly 134 approximate the end gear 175 of the drive shaft 176.

The front bearing 116 engages drum assembly 170. In particular, bushing 174 is positioned between a portion of the drive shaft 176 and the bore 169 of the drum assembly 170 and a ring seal 172 is positioned between the front bearing 116 and the drum assembly 170. Similarly, an end bearing 108 engages another side of the drum assembly 170. In particular, bushing 168 is positioned around the bore 169 of the drum assembly and a ring seal 166 is positioned around an end of the drum assembly 170. The front bearing 116 is coupled to the end bearing 108 via tie bars 110 and 111 and respective fasteners 187 and 151 and washers 189 and 153.

The gearing side of the winch 120 of FIG. 1B further includes a ring assembly 106 that is coupled to the end bearing 108 with gasket 150 there between. The ring assembly 106 includes internal gear rings that are further described below in regards to FIGS. 3A through 3C. A second planetary gear carrier assembly 144 is received in the ring assembly 106. The second planetary gear assembly 144 (or generally the second gear carrier assembly 144) includes a drive gear 148 that engages internal gears 171 in bore 169 of the drum assembly 170. The drive gear 148 includes a bore (not shown in FIG. 1B) that allows the drive shaft 176 to pass through. The second gear carrier assembly 144 further includes a ring plate 146 upon which the drive gear 148 is coupled. The ring plate 146 also includes a bore (not shown in FIG. 1B) that allows the drive shaft 176 to pass through. The second gear carrier assembly 144 further includes a plurality of planet gears 145 that are rotationally attached to ring plate 146. In this embodiment, four planetary gears 145 are used in the second gear carrier assembly 144. In other embodiments other numbers of planetary gears are used. The planet gears 145 engage an interior gear ring 306 (shown below in FIG. 3A through FIG. 4) in the ring assembly 106. The use of planetary gear assemblies, such as the second gear assembly 144 allows for drastic gear ratio possibilities.

Figure 3A:
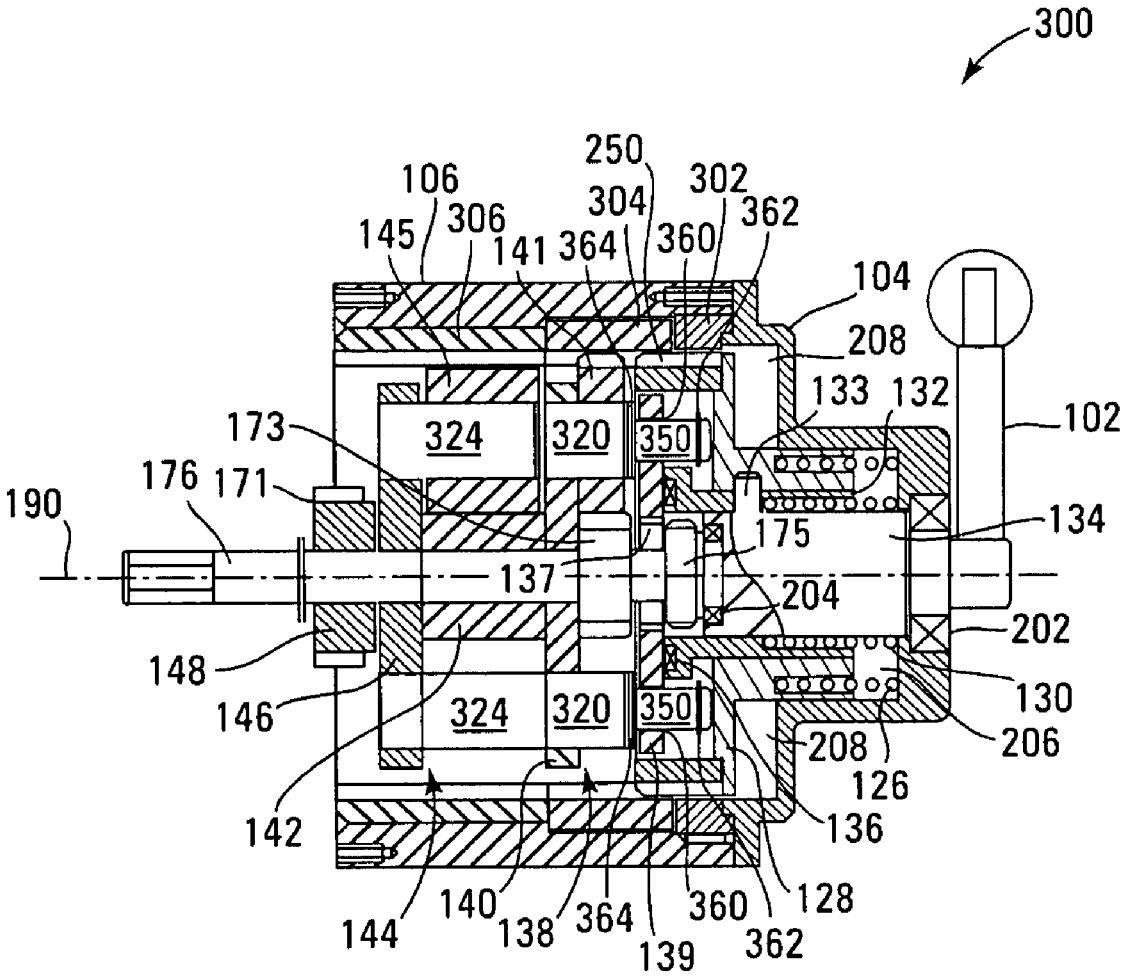
FIG. 3A is a cross-sectional side view of a gearing section of a winch illustrating a low gearing of one embodiment of the present invention.
Figure 3B:
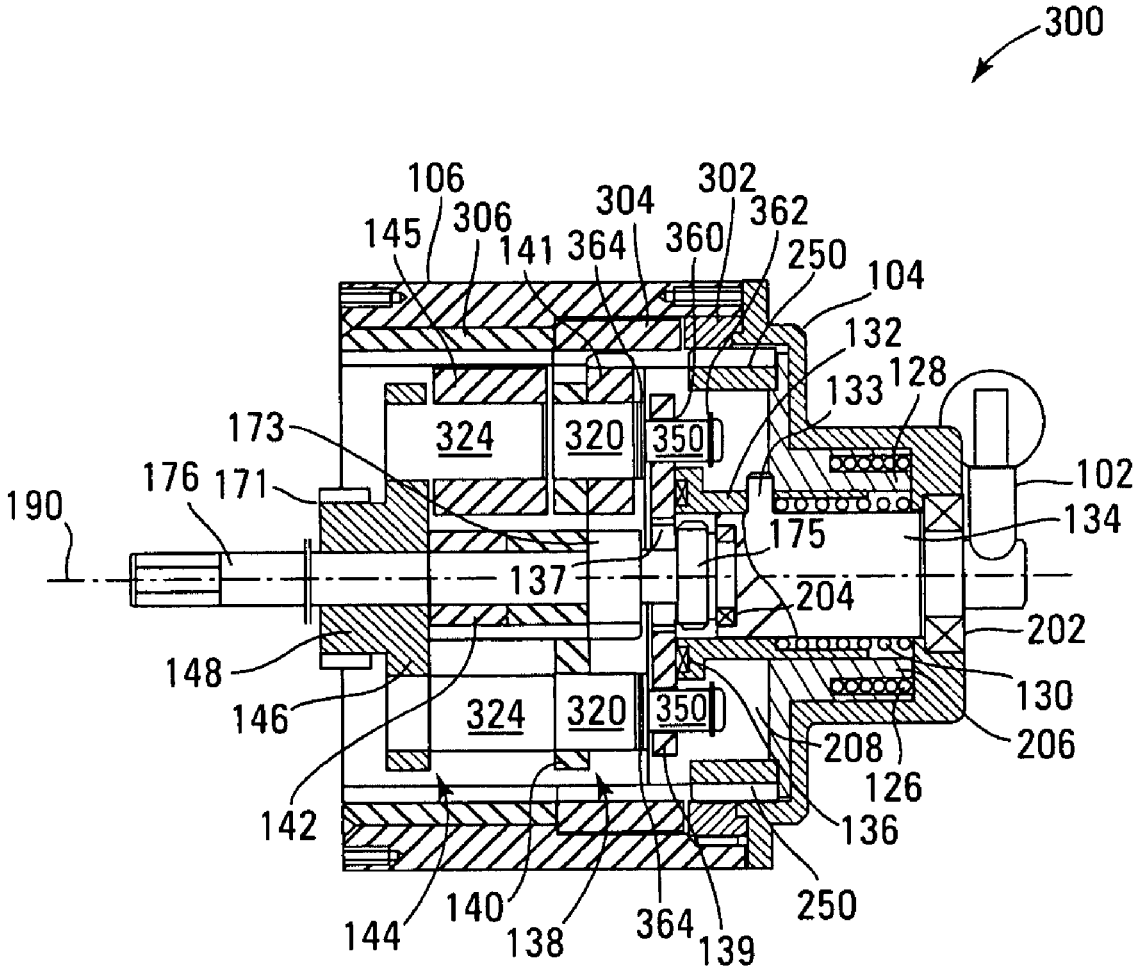
FIG. 3B is a cross-sectional side view of a gearing section of a winch illustrating a free spooling gearing of one embodiment of the present invention.
Figure 3C:
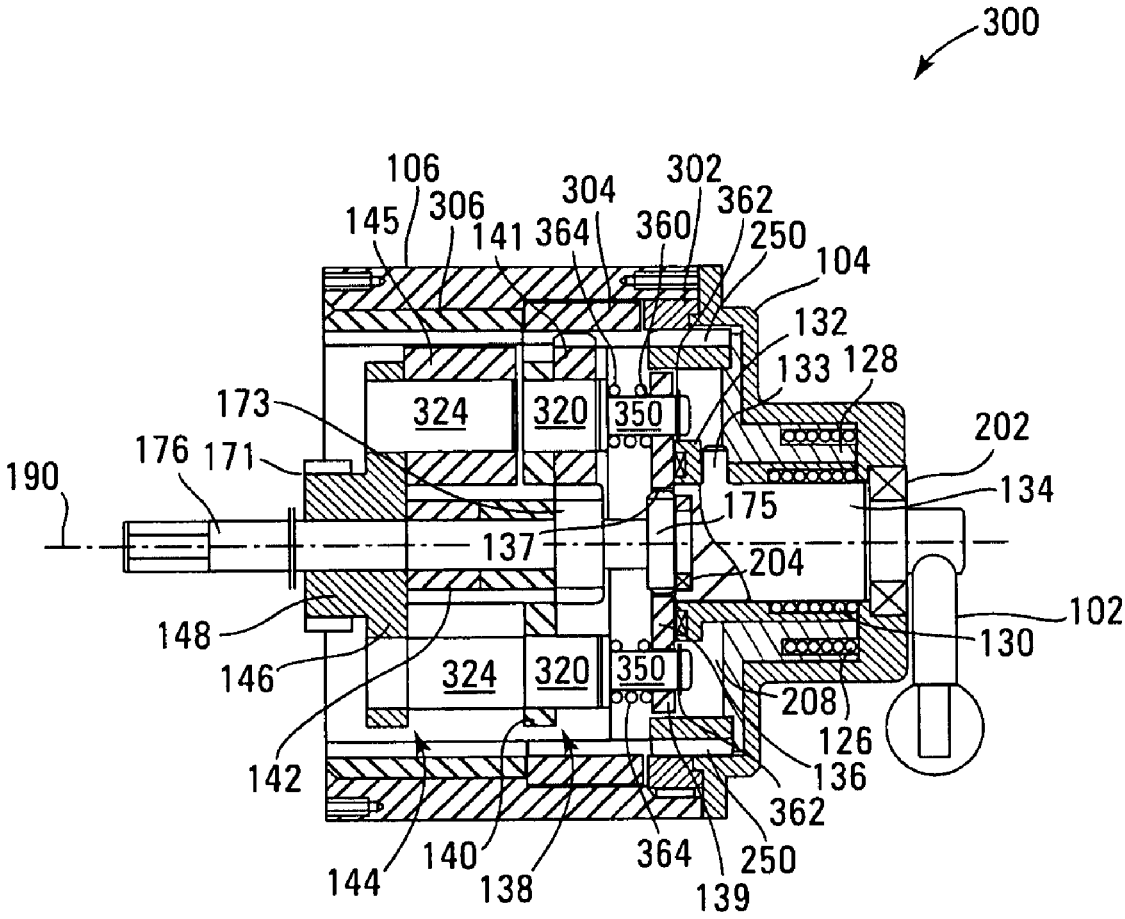
FIG. 3C is a cross-sectional side view of a gearing section of a winch illustrating a high gearing of one embodiment of the present invention.
Figure 4:
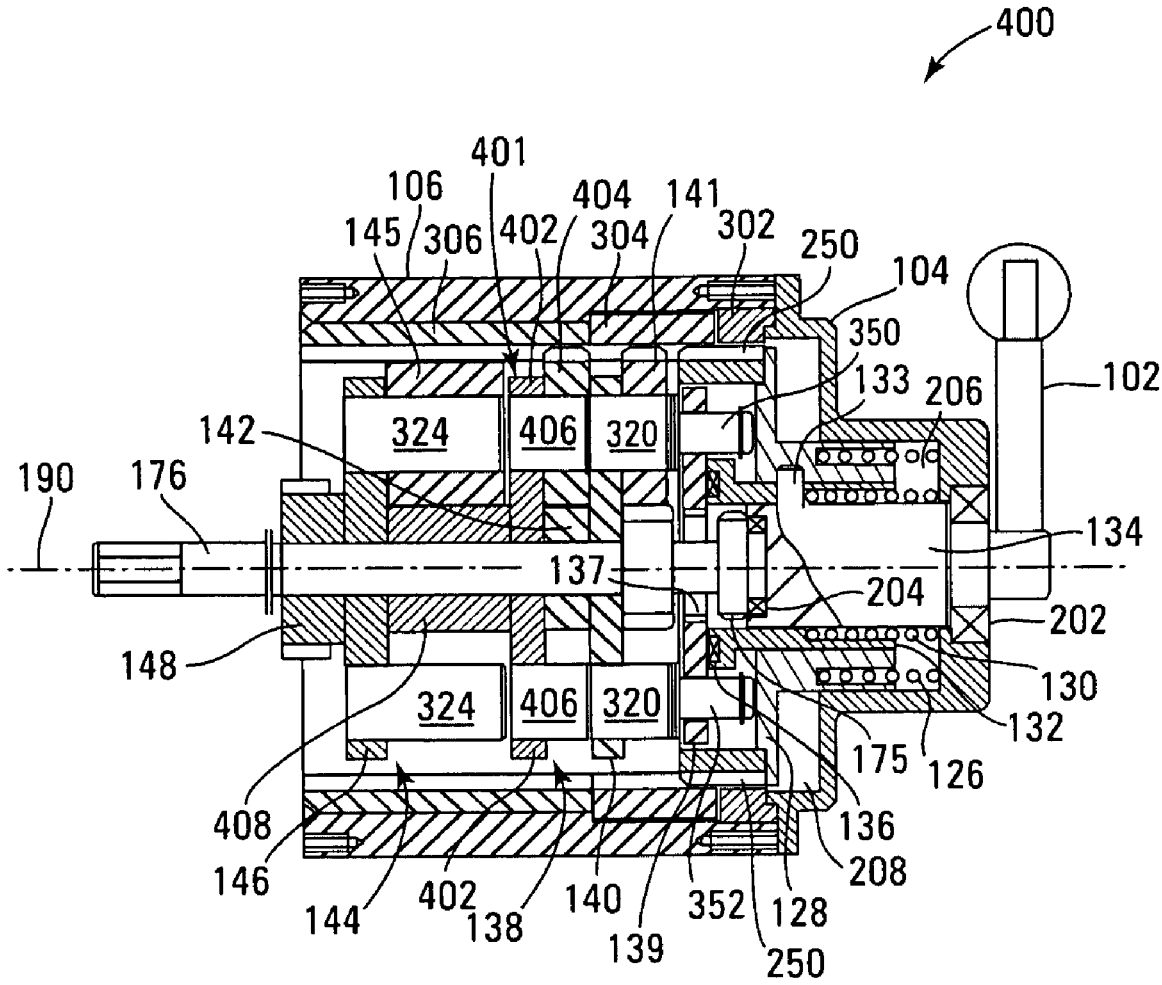
FIG. 4 is a cross-sectional side view of a gearing section of a winch illustrating the addition of a gear carrier assembly of one embodiment of the present invention.

The gearing side of the winch 120 further includes a first gear carrier assembly 138. The first gear carrier assembly 138 in this embodiment can be generally referred to as a variable gear carrier assembly 138. The variable gear carrier assembly 138 includes a sun gear 142 that is coupled to a first ring plate 140. The sun gear 142 and the first ring plate 140 include bores (not shown in FIG. 1B) that allows the drive shaft 176 to pass through. Sun gear 142 of the gear carrier assembly 138 engages the planet gears 145 of the second gear carrier assembly 144. The variable gear carrier assembly 138 further includes a plurality of planet gears 141 that are rotationally coupled to the first ring plate 140. The variable gear carrier assembly 138 also includes a second ring plate 139. The planet gears 141 are also rotationally coupled to the second ring plate 139 such that the planet gears 141 are rotationally positioned between the first and second ring plates 140 and 139. Gear carrier assembly 138 is received in the ring assembly 106. Planet gears 141 of the first gear carrier assembly 138 engage a mid rotational gear ring 304 in the ring assembly 106 (this is shown in FIGS. 3 through 4). The second ring plate 139 of the variable gear carrier assembly 138 includes a bore defined by interior gears 137. The bore of the second ring plate 139 allows the drive shaft 176 to pass through to the clutch axis assembly 134. Further discussion on the construction of the variable gear carrier assembly 138 is discussed below in relation to FIGS. 3A through 3C.

Assembled, the end gear 175 of the drive shaft 176 selectively engages the interior gears 137 of the first gear ring 139 of first gear carrier assembly 138. Further, sun gear 173 of the drive shaft 176 selectively engages planet gears 141 of the first gear carrier assembly 138. A thrust washer 136 is positioned on the clutch axis assembly 134 to abut the first gear ring 139. As illustrated, the clutch axis assembly 134 includes a gear selection knob 133 (or knob 133) that fits into a slot 129 in a clutch housing 132 as the clutch axis assembly 134 is received in the clutch housing 132. The slot 129 has at least a portion that is helical. Therefore the slot 129 of the clutch housing 132 can generally be referred to as a helical slot 129. The clutch axis assembly 134 further includes a receiving portion 135. The clutch housing 132 further includes a guide slot 131 that receives a tab 502 (shown in FIG. 5) in the cam clutch gear 128. A clutch housing spring 130 is positioned between the clutch housing 132 and an inner surface of gear housing 104 to provide a bias force on the clutch housing 132. The clutch housing 132 is received in the cam clutch gear 128. The cam clutch gear 128 includes an outer gear 250 and a receiving track 252. The outer gear 250 of the cam clutch gear 128 engages an outer stationary gear ring 302 (shown below in FIGS. 3 through 4) of the ring assembly 106. A clutch gear spring 126 is received in the receiving track 252 of the cam clutch gear 128. The clutch gear spring 126 abuts the inner surface of the gear housing 104 to provide a biasing force on the cam clutch gear 128. A retaining device 122 connects an operation hub 222 with an operation lever 102 to the receiving portion 135 of the clutch axis assembly 134. To prevent the operation hub from rotating about the receiving portion 135 of the clutch axis assembly 134, a set screw 121 is received in a threaded aperture (not shown In FIG. 1B) in the operation hub 222 and engaged with the receiving portion 135. Moreover, as illustrated in FIG. 1B, the gear housing 104 is coupled to the ring assembly 106 via fasteners 124 and washer 125. Also further illustrated in FIG. 1B, are fasteners 182, 184, 154 and 156 along with washers and nuts 160, 158, 164, 162, 185, 186, 187 and 188 are used to mount the winch 120 to a device such as but not limited to a truck.

Figure 2:
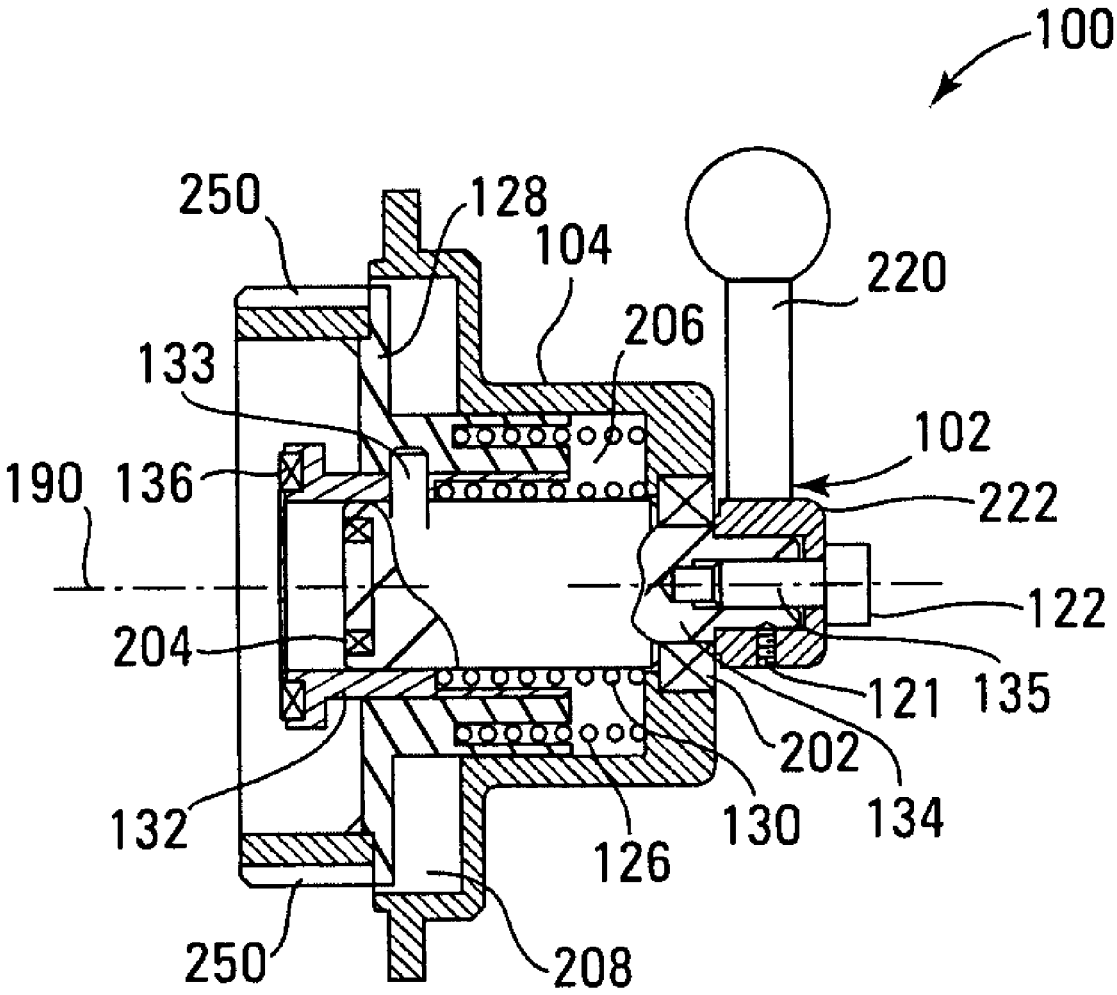
FIG. 2 is a cross-sectional side view of a portion of a gearing section of a winch of one embodiment of the present invention.

Referring to FIG. 2, a cross-sectional side view of a portion of a gear changing system 200 of a winch of FIG. 1B in illustrated. As illustrated, a handle portion 220 of the operation lever 102 is used to select a desired gear of the winch by rotating the clutch axis assembly 134. The clutch axis assembly 134 includes knob 133 that fits into helical slot 129 in the clutch housing 132. Movement of knob 133 in slot 129 causes the clutch access assembly 134 to move in a direction along axis 190. An internal clutch positioning groove 504 (illustrated in FIG. 5) in the cam clutch gear 128 also receives knob 133. The movement of the knob 133 in groove 504 (groove 504) moves the cam clutch gear 128 in a direction along axis 190. Hence, as the operation lever 102 is moved, knob 133 moves the clutch housing 132 and the cam clutch gear 128 in a direction along axis 190 depending on the then current position of the knob 133 in the slot 129 of the clutch housing 132 and the then current position of knob 133 in the groove 504 of the cam clutch gear 128. This action changes the gearing in the winch. Further discussion regarding the positioning of the knob 133 in the slot 129 of the clutch housing 132 and the groove 504 of the cam clutch gear is described in regards to FIG. 5.

As further illustrated in FIG. 2, the clutch gear spring 126 is positioned to provide a bias between the cam clutch gear 128 and an interior surface of gear housing 104. The clutch gear spring 126 provides a bias force on the cam clutch gear 128 so that it moves along axis 190 to shift gearing of the winch. Also illustrated in FIG. 2, is clutch housing spring 130. Clutch housing spring 130 provides a bias between the clutch housing 132 and the interior surface of the gear housing 104. The clutch housing spring 130 provides a bias force on the clutch housing 132 so that it moves along axis 190 to shift gearing of the winch. The movement to shift gearing with the clutch housing 132 and the cam clutch gear 128 are further discussed below in regards to FIGS. 3A through 3C. FIG. 2 also illustrates gear housing bearing 202, clutch bearing 204 and thrust washer 136.

FIGS. 3A through 3C, are cross-sectional side views of the gear side 300 of the winch 120 of FIG. 1B illustrating the different positioning of components to achieve different gearing. These views not only include the portion of the gear section 200 of FIG. 2, but also include the ring assembly 106, the first gear carrier assembly 138, the second gear carrier assembly 144 and the drive shaft 176 that make up a variable gearing system. In the embodiments of FIGS. 3A through 3C, the drive shaft 176 is rotationally coupled to clutch axis assembly 134 proximate the end gear 175 of the drive shaft 176. The motor 118 provides rotation of the drive shaft 176 in a select direction to rotate the drum 170. FIG. 3A illustrates, the gear side 300 being in a low gear configuration. This configuration would be used when pulling strength is needed. FIG. 3B illustrates, the gear side 300 being in a free spool configuration. This configuration is used when pulling the cable 112 from the drum to place the cable 112 in position for use. FIG. 3C illustrates, the gear side 300 being in a high gear configuration. This configuration would be used when winding the cable 112 up on the drum 170 to store the cable 112 on the drum 170 after use. The different gear configurations are achieved by rotating the operation lever 102.

Referring to FIGS. 3A through 3C, the first gear carrier assembly 138 (or variable gear carrier assembly 138) is illustrated as having the first ring plate 140, the second ring plate 139, planet gears 141 and sun gear 142. Also illustrated are hubs 320 upon which planet gears 141 are rotationally engaged. The hubs 320 include guide pin portions 350. The guide pin portions 350 are received in guide apertures 360 in the second ring plate 139. Retaining clips 362 are used to retain the guide pin portions 350 in the guide apertures 360 of the second ring plate 139. Hence, the second ring plate 139 is slide-ably attached to the hubs 320 of the first gear carrier assembly 138. Biasing members 364 are used to provide a biasing force on the second ring plate 139 to push it away from the hubs 320. However, in FIGS. 3A and 3C, the biasing members 364 are compressed in their respective gearing arrangement by the positioning of the clutch housing 132 as illustrated. The biasing member 364 of the first gear carrier 138 is better illustrated in FIG. 3C. In one embodiment, biasing members 364 are springs.

As further illustrated in FIGS. 3A through 3C, the second ring plate 139 of the variable gear carrier assembly 138 includes interior gear 137. The interior gear 137 selectively engages the end gear 175 of the drive shaft 176. In particular, the end gear 175 engages the interior gear 137 of second ring plate 139 of the variable gear carrier assembly 138 when the clutch housing 132 is moved in a direction along axis 190 away from the variable gear carrier assembly 138. This is illustrated in FIG. 3C in regards to high gear configuration. The biasing members 362 force the second ring plate 139 to the end gear 175 of the drive shaft 176. The clutch housing 132 is moved in a direction along axis 190 via the positioning of the knob 133 of clutch axis assembly 134 in the helical slot 129 of the clutch housing 132 as discussed above. The positioning of the knob 133 is achieved with movement of the operation level 102. In FIG. 3A, the positioning of the knob 133 in the helical slot 129 has positioned the interior gear 137 of the second ring plate 139 away from the end gear 175 of the drive shaft 176.

As further illustrated in FIGS. 3A, 3B and 3C the drive shaft sun gear 173 of the drive shaft 176 engages the planet gears 141 of the variable gear carrier assembly 138. The first ring plate 140 of the variable gear carrier assembly 138 is coupled to sun gear 142. Sun gear 142 of the variable gear carrier assembly 138 engages the planet gears 145 of the second gear carrier assembly 144. The planet gears 145 of the second gear carrier assembly 144 are rotationally connected to ring plate 146 of the second gear carrier assembly 144 via hubs 342. The drive gear 148 of the second gear carrier assembly 144 that is coupled to ring plate 146 is engaged with internal gear threads 171 of the drum assembly 170 to turn the drum assembly 170.

Ring assembly 106 include three gear rings, an inner stationary gear ring 306, a mid rotational gear ring 304 and an outer stationary gear ring 302 as illustrated in FIGS. 3A through 3C. The inner stationary gear ring 306 is engaged with the planet gears 145 of the second gear carrier assembly 144. Further as illustrated, the mid rotational ring 304 is rotationally coupled to the ring assembly 106. The planet gears 141 of the variable gear carrier assembly 138 engage the mid rotational gear ring 304 of the ring assembly 106. The outer stationary ring gear 302 is engaged with the outer gear 250 of the cam clutch gear 128. The outer gear 250 of the cam clutch gear 128 also selectively engages the mid rotational gear ring 304 as illustrated in FIG. 3A. When the outer gear 250 of the cam clutch gear 128 engages the mid rotational gear ring 304, it prevents the mid rotational gear ring 304 from rotating. The outer gear 250 of the cam clutch gear 128 is positioned to engage the mid rotational ring gear 304 via positioning the knob 133 in groove 504 in the cam clutch gear 128 as further describe below in relation to FIG. 5.

Referring to FIG. 4, another embodiment of the gearing system 400 of a winch is illustrated. This embodiment, illustrates the use of an addition mid gear carrier assembly 401 to achieve a further gear ratio to increase the pulling strength of the winch. The mid gear carrier assembly 401 includes planet gears 404 configured to engage sun gear 142 of the variable gear carrier assembly 138. The planet gears 404 are rotationally coupled to a ring plate 402 of the mid gear carrier assembly 140 via hubs 406. The planet gears 404 engage the inner stationary gear ring 306 of the ring assembly 106. A sun gear 324 is coupled to the ring plate 402 of the mid gear carrier assembly 140. Sun gear 408 of the mid gear carrier assembly 140 engages the planet gears 145 of the second gear carrier assembly 144. Hence, embodiments are not limited to a specific number of gear carrier assemblies used to achieve a desired gearing ratio.

Figure 5:
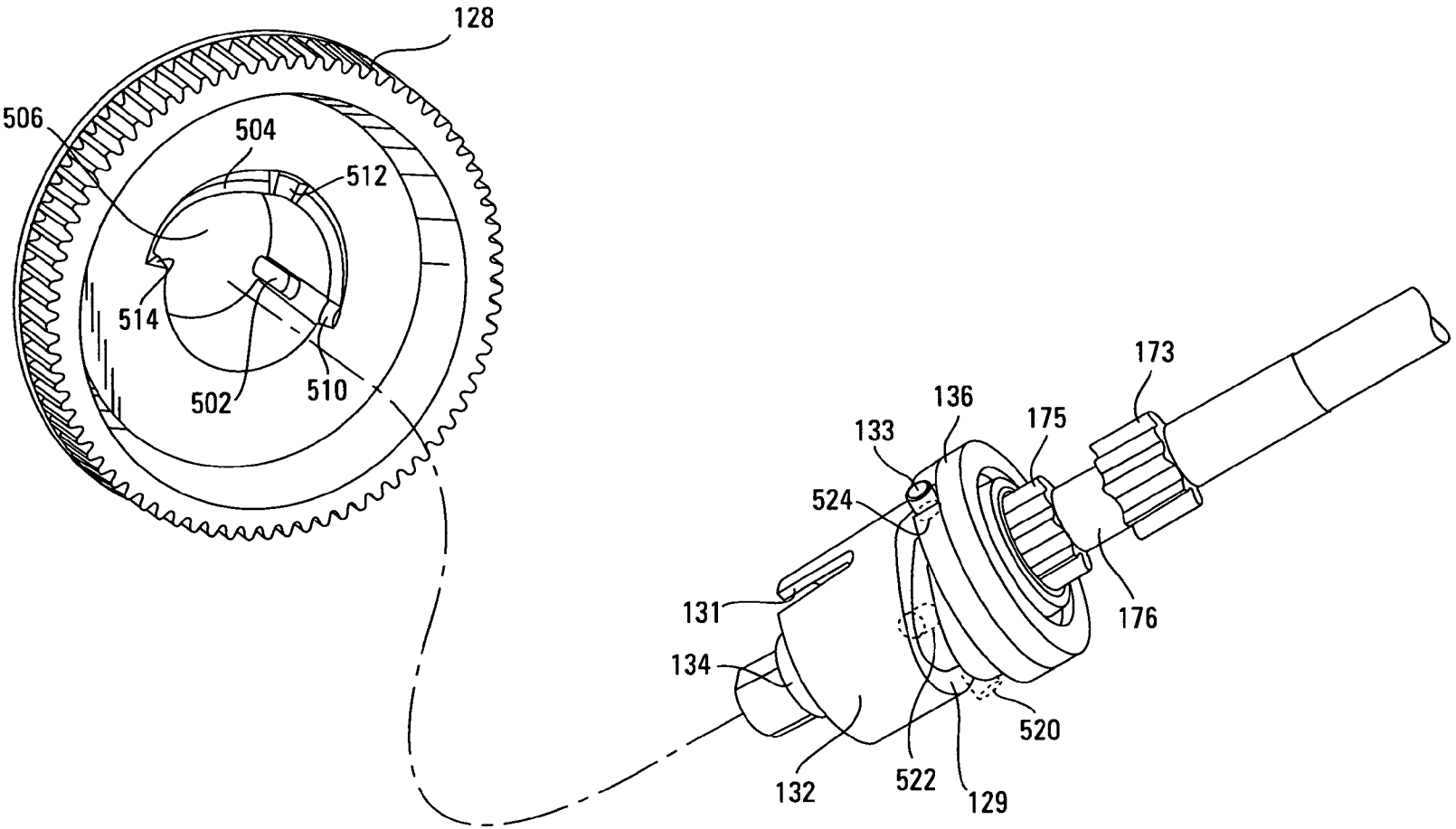
FIG. 5 is a side perspective view of how the cam clutch gear, clutch axes assembly and clutch housing fit together in one embodiment of the present invention.

FIG. 5 further illustrates the cam clutch gear 128, the clutch housing 132 and the clutch axis assembly 134. In particular, FIG. 5 illustrates how the above mentioned components fit together to change the gearing of the winch. As illustrated, the clutch axis assembly 134 is received in the clutch housing 132 such that the knob 133 of the clutch axis assembly 134 is received in slot 129 of the clutch housing 132. As further illustrated, the cam clutch gear 128 includes an interior passage 506 that receives the clutch housing 132. In particular, a tab 502 in the interior passage 506 of the cam clutch gear 128 is received in the guide slot 131 of the clutch housing 132 to position the clutch housing 132 in the cam clutch gear 128. As further illustrated, the cam clutch gear 128 includes a cam clutch positioning groove 504. The gear selection knob 133 is received in the cam clutch positioning groove 504 (groove 504). The cam clutch positioning groove 504 of the cam clutch gear 128 has three positions that position the cam clutch gear 128 within the gearing side of the winch. Likewise the clutch housing 132 has three positions that position the clutch housing 132 within the gearing side of the winch. It is the positioning of the cam clutch gear 128 and clutch housing 132 that determines the gearing of the winch as illustrated above in regards to FIGS. 3A through 3C.

To achieve a desired gearing, knob 133 of the clutch axis assembly 134 is rotated to a select position in the groove 504 of the cam clutch gear 128 and the slot 129 of the clutch housing 132. For example, to achieve a high gearing, the knob 133 is rotated into position 510 of groove 504 in the cam clutch gear 128 and position 524 in slot 129 of the clutch housing. The positioning of the cam clutch gear 128 and the clutch housing 132 that results in the high gearing is illustrated and described above in regards to FIG. 3C. As FIG. 3C illustrates, positioning the knob 133 in position 510 of groove 504 in the cam clutch gear 128 and position 524 in slot 129 of the clutch housing 132 forces the cam clutch gear 128 and the clutch housing 132 toward the interior surface of the gear housing 104 along axis 190 thereby compressing the clutch housing biasing member 130 and the clutch gear biasing member 126. The forcing of the clutch housing 132 to the interior surface of the gear housing 104 allows biasing members 364 to force the interior gear 137 of the second ring plate 139 of the variable gear carrier assembly 138 to engage the end gear 175 of the drive shaft 176.

To achieve the free spool gearing, the knob 133 is rotated into position 512 of groove 504 of the cam clutch gear 128 and position 522 of slot 129 of the clutch housing 132. The positioning of cam clutch gear 128 and the clutch housing 132 to achieve the free spool gearing is illustrated and described above in regards to FIG. 3B. As FIG. 3B illustrates, positioning the knob 133 in position 512 of groove 504 in the cam clutch gear 128 and position 522 in slot 129 of the clutch housing 132 forces the clutch housing 132 on the second ring plate 139 of the variable gear carrier assembly 138 to compress biasing members 364. This disengages the interior gear 137 of the second ring plate 139 of the variable gear carrier assembly 138 from the end gear 175 of the drive shaft 176.

To achieve the low gearing, the knob 133 is rotated into position 514 of groove 504 of the cam clutch gear 128 and position 520 of slot 129 of the clutch housing 132. The positioning of the cam clutch gear 128 and the clutch housing 132 to achieve the low gearing is illustrated and described above in regards to FIG. 3A. As FIG. 3A illustrates, positioning the knob 133 in position 514 of groove 504 in the cam clutch gear 128 and position 520 in slot 129 of the clutch housing 132 forces the clutch housing 132 on the second ring plate 139 of the variable gear carrier assembly 138 to compress biasing members 364 and the outer gear 250 of the outer gear of the cam clutch gear 128 to engage the mid rotational gear ring 304 of the ring assembly 106.

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

The invention claimed is:

1. A variable speed winch comprising:

a drive shaft;

a power source configured to rotate the drive shaft;

a single gear operation lever;

a variable gearing system in rotational connection with the drive shaft, the variable gearing system configured to change gearing based on the rotation of the single gear operation lever;

a drum in rotational connection with the variable gearing system;

a clutch axis assembly coupled to the gear operation lever such that when the gear operation lever is rotated the clutch axis assembly is rotated, the clutch axis assembly having a gear positioning knob extending from a surface of the clutch axis assembly;

a clutch housing having a helical slot, the clutch axis assembly received in the clutch housing such that the gear positioning knob of the clutch axis assembly extends through the helical slot of the clutch housing; and a cam clutch gear having an internal clutch positioning groove, the clutch housing received in the cam clutch gear such that the gear position knob extending through the helical slot of the clutch housing is received in the clutch positioning groove, wherein rotation of the operation handle moves the gear positioning knob of the clutch assembly in the respective helical slot of the clutch housing and in the clutch positioning groove of the cam clutch gear to change gearing of the variable speed winch.

2. The variable speed winch of claim 1, wherein the variable gearing system is configured to change gearing between a high speed gear, a low speed gear and free spool.

3. The variable speed winch of claim 1, further comprising:

a variable carriage gear assembly including, a first plate having a first side and a second side, the first plate having central opening, a portion of the drive shaft passing through the central opening, a plurality of planet gears rotationally coupled to the second side of the first plate, a sun gear of the drive shaft engaging the planet gears, a second plate having a central opening, the central opening defining an interior gear, the second plate slide-ably coupled to first plate, wherein the second plate is selectively movable along a central axis in relation to the first plate to selectively engage the interior gear of the second plate to an end gear of the drive shaft, and an output sun gear coupled around the central opening of the first side of the first plate; and at least one carriage gear assembly, each carriage gear assembly including, a ring plate having a central opening, the drive shaft passing through the central opening, a plurality of planet gears rotationally coupled to a first side of the ring plate, the planet gears having a rotational connection with the output sun gear of the variable carriage gear assembly, and a drive gear coupled to a second side of the ring plate around the central opening, the drive gear in rotational connection with the drum.

4. The variable speed winch of claim 3, further comprising:

a ring assembly having an inner stationary gear ring, a mid rotational gear ring and a outer stationary gear ring, the planet gears of the variable carriage gear assembly being engaged with the mid rotational gear ring, the planet gears of the at least one carrier gear assembly being engaged with the inner stationary gear ring, an outer gear of the cam clutch gear engaged with the outer stationary gear ring, the outer gear of the cam clutch gear further selectively engaged with the mid rotational ring to lock the mid rotational gear in place based on a position of the gear selection knob in the clutch positioning groove the cam clutch gear.

5. The winch of claim 4, further comprising:

a gear housing coupled to the ring assembly, the gear housing configured to enclose the cam clutch gear, the clutch housing and the clutch axis assembly, the gear housing having an interior surface;

a clutch biasing member position between the clutch housing and the interior surface of the gear housing to apply a biasing force on the clutch housing; and a clutch gear biasing member positioned between the cam clutch gear and the interior surface of the gear housing to apply a biasing force on the cam clutch.

6. A winch comprising:

a drive shaft;

a power source configured to rotate the drive shaft;

a variable gearing system coupled to receive the rotational movement of the drive shaft, the variable gearing system configured to select a gearing of the winch based on the positioning of a gear position knob in a helical slot of a first clutch member and in a groove in a second clutch member of the variable gearing system;

a drum in rotational connection with the variable gearing assembly;

an operation lever;

a clutch axis assembly coupled to the operation lever, the gear positioning knob extending from a surface of the clutch access assembly;

the first clutch member being a clutch housing, the clutch housing having an interior passage in which the clutch axis assembly is received, the gear positioning knob extending through the helical slot of the clutch housing; and the second clutch member being a cam clutch gear, the cam clutch gear having an interior passage in which the clutch housing is received, the gear positioning knob being received in the groove of the cam clutch gear, the cam clutch gear having an outer gear.

7. The winch of claim 6, wherein the power source is one of electrical and hydraulic.

8. The winch of claim 6, wherein the variable gearing system further comprises:

a variable gear carriage assembly including, a first ring plate having a central opening in which the drive shaft passes there through, a variable gear carrier sun gear coupled to a first side of the first ring plate around the central opening, a plurality of hubs extending from a second side of the first ring plate, a planet gear rotationally coupled to each hub, the planet gears rotationally engaged with the drive shaft sun gear, each hub further having a guide pin portion extending away from the second surface of the first ring plate, a second ring plate having a guide aperture for each guide pin portion, each guide pin portion being slideably received in an associated guide aperture, the second ring plate further having a central opening in which the drive shaft passes there through, the central opening further defining an interior gear that selectively engages the end gear of the drive shaft depending on the position of the positioning knob in the helical slot of the clutch housing, and a biasing member for each guide pin, each biasing member received around an associated guide pin applying a force between an associated hub and the second ring plate to engage the interior gear of the central opening of the second ring with the end gear of the drive shaft.

9. The winch of claim 8, further comprising:

at least one carriage gear assembly, each carriage gear assembly including, a ring plate having a central opening, the drive shaft passing through the central opening, a plurality of planet gears rotationally coupled to a first side of the ring plate, the planet gears having a rotational connection with the variable gear carrier sun gear of the variable carriage gear assembly, and a drive gear coupled to a second side of the ring plate around the central opening, the drive gear in rotational connection with the drum.

10. The winch of claim 9, further comprising:

a ring assembly having an inner stationary gear ring, a mid rotational gear ring and a outer stationary gear ring, the planet gears of the variable carriage gear assembly being engaged with the mid rotational gear ring, the planet gears of the at least one carrier gear assembly being engaged with the inner stationary gear ring, an outer gear of the cam clutch gear engaged with the outer stationary gear ring, the outer gear of the cam clutch gear further selectively engaged with the mid rotational ring to lock the mid rotational gear in place based on a position of the gear selection knob in the groove of the cam clutch gear.

11. The winch of claim 10, further comprising:

a gear housing coupled to the ring assembly, the gear housing configured to enclose the cam clutch gear, the clutch housing and the clutch axis assembly, the gear housing having an interior surface;

a clutch biasing member position between the clutch housing and the interior surface of the gear housing to apply a biasing force on the clutch housing; and a clutch gear biasing member positioned between the cam clutch gear and the interior surface of the gear housing to apply a biasing force on the cam clutch.

12. A winch comprising:

a drive shaft having a sun gear and an end gear, the drive shaft positioned along a central axis;

a power source configured to rotate the drive shaft;

a variable carriage gear assembly including, a first plate having a first side and a second side, the first plate having central opening, a portion of the drive shaft passing through the central opening, a plurality of planet gears rotationally coupled to the second side of the first plate, the sun gear of the drive shaft engaging the planet gears, a second plate having a central opening, the central opening defining an interior gear, the second plate coupled to first plate, the second plate being selectively movable along the central axis in relation to the first plate to selectively engage the interior gear of the second plate to the end gear of the drive shaft, an output sun gear coupled around the central opening of the first side of the first plate;

a ring assembly having an internally selective movable ring gear, the planet gears of the variable carriage gear assembly being engaged with the selectively movable ring gear of the ring assembly;

a drum in rotational communication with the output sun gear of the variable carriage gear assembly;

a gearing changing system configured to manipulate the second plate of the variable carrier assembly and the internally selective movable ring gear of the ring assembly to change gears of the winch;

a clutch axis assembly having a gear positioning knob extending from a surface of the clutch axis assembly;

a clutch housing having a helical slot, the clutch axis assembly received in the clutch housing such that the gear positioning knob of the clutch axis assembly extends through the helical slot of the clutch housing; and a cam clutch gear having an internal clutch positioning groove, the clutch housing received in the cam clutch gear such that the gear position knob extending through the helical slot of the clutch housing is received in the clutch positioning groove, wherein positioning of the gear positioning knob in the helical slot of the clutch housing manipulates the second plate of the variable carrier assembly and positioning of the gear positioning knob in the internal clutch positioning groove of the cam clutch manipulates the internally selective movable ring gear.

13. The winch of claim 12, further comprising:

a gear housing coupled to the ring assembly, the gear housing configured to enclose the cam clutch gear, the clutch housing and the clutch axis assembly, the gear housing having an interior surface;

a clutch biasing member position between the clutch housing and the interior surface of the gear housing to apply a biasing force on the clutch housing; and a clutch gear biasing member positioned between the cam clutch gear and the interior surface of the gear housing to apply a biasing force on the cam clutch.

14. The winch of claim 12, further comprising:

an operation lever coupled to rotate the clutch axis assembly.

15. The winch of claim 12, further comprising;

at least one carriage gear assembly, each carriage gear assembly including, a ring plate having a central opening, the drive shaft passing through the central opening, a plurality of planet gears rotationally coupled to a first side of the ring plate, the planet gears having a rotational connection with the variable gear carrier sun gear of the variable carriage gear assembly, and a drive gear coupled to a second side of the ring plate around the central opening, the drive gear in rotational connection with the drum.

16. The winch of claim 15, wherein the ring assembly further comprises:

an inner stationary gear ring and a outer stationary gear ring, the mid rotational ring positioned between the inner stationary gear ring and the outer stationary gear ring, the planet gears of the at least one carrier gear assembly being engaged with the inner stationary gear ring, an outer gear of a cam clutch gear engaged with the outer stationary gear ring, the outer gear of the cam clutch gear further selectively engaged with the mid rotational ring to lock the mid rotational gear in place based on a position of the gear selection knob in the groove of the cam clutch gear.

17. The winch of claim 12, wherein the variable carriage gear assembly, further comprises:

a plurality of hubs extending from a second side of the first ring plate, the planet gears rotationally coupled to each hub, each hub further having a guide pin portion extending away from the second surface of the first ring plate, the second ring plate having a guide aperture for each guide pin portion, each guide pin portion being slide-ably received in an associated guide aperture, and a biasing member for each guide pin, each biasing member received around an associated guide pin applying a force between an associated hub and the second ring plate to engage the interior gear of the central opening of the second ring with the end gear of the drive shaft.

* * * * *